US007290815B1

(12) United States Patent
Whittington

(10) Patent No.: US 7,290,815 B1
(45) Date of Patent: Nov. 6, 2007

(54) HOIST SLING

(76) Inventor: Jerry L Whittington, 211 Oregon, Odessa, TX (US) 79764-2431

( * ) Notice: Subject to any disclaimer, the term of this patent is extended or adjusted under 35 U.S.C. 154(b) by 264 days.

(21) Appl. No.: 11/201,952

(22) Filed: Aug. 11, 2005

(51) Int. Cl.
*B66C 1/00* (2006.01)

(52) U.S. Cl. ..... 294/67.4; 294/81.55

(58) Field of Classification Search ..... 294/81.1, 294/81.2, 81.55, 81.4, 67.4, 67.5, 67.1, 67.3
See application file for complete search history.

(56) References Cited

U.S. PATENT DOCUMENTS

| | | | | | |
|---|---|---|---|---|---|
| 762,875 | A | * | 6/1904 | Blodgett | 294/81.55 |
| 1,027,907 | A | | 5/1912 | Sammon | |
| 1,401,206 | A | * | 12/1921 | Swartz | 294/74 |
| 1,834,902 | A | * | 12/1931 | Payzant | 294/67.4 |
| 1,918,007 | A | * | 7/1933 | Woodruff | 294/68.3 |
| 1,931,931 | A | * | 10/1933 | Mueller | 294/81.55 |
| 2,235,719 | A | * | 3/1941 | Matarese | 294/67.41 |
| 2,998,994 | A | * | 9/1961 | Karr | 294/68.21 |
| 3,764,032 | A | | 10/1973 | Ward | |
| 3,945,674 | A | * | 3/1976 | Ide | 294/67.1 |
| 4,388,032 | A | | 6/1983 | Stohler et al. | |
| 4,538,849 | A | * | 9/1985 | Khachaturian et al. | 294/81.1 |
| 4,826,228 | A | * | 5/1989 | Dinitz et al. | 294/81.56 |
| 5,163,726 | A | | 11/1992 | Boos et al. | |

FOREIGN PATENT DOCUMENTS

| | | |
|---|---|---|
| GB | 2.041.885 | 9/1980 |
| GB | 1.583.642 | 1/1981 |
| JP | 2004250188 | 9/2004 |
| WO | WO2004106214 | 12/2004 |

* cited by examiner

*Primary Examiner*—Gene O. Crawford
*Assistant Examiner*—Esther O Okezie
(74) *Attorney, Agent, or Firm*—Michael I Kroll

(57) ABSTRACT

Apparatus 10 discloses an improved hoisting sling specially for palletized 28 loads comprising a pair of skids 12, 14 having opposing ends, each with a channel 16 terminating in a puck-shaped cavity 18 forming means of engagement of lengths of load bearing members 20 having mating puck-shaped members 30 thereon. The load bearing members 20 extend from distal ends of a spreader frame 22 extending between and having means for engaging the load bearing members. Depending from the intersection of the spreader arms 22 an anchor line 24 extends to a common load bearing member 26 serving as terminus for load bearing members extending to the terminal ends of the spreader arms and also serving as point of attachment for a user selected hoisting device.

10 Claims, 11 Drawing Sheets

HOIST SLING

BACKGROUND OF THE INVENTION

1. Field of the Invention

The present invention relates generally to hoisting and, more specifically, to an improved hoisting sling, specially palletized loads comprising a pair of blades having opposing ends, each with a channel terminating in a puck-shaped cavity forming means of engagement for lengths of load bearing members having mating puck-shaped members thereon. The load bearing members extend from distal ends of a spreader frame extending between and having means for engaging the load bearing members. Depending from the intersection of the spreader arms an anchor line extends to a common load bearing member serving as terminus for load bearing members extending to the terminal ends of the spreader arms and also serving as point of attachment for a user selected hoisting device.

2. Description of the Prior Art

There are other hoist devices designed for load bearing. Typical of these is U.S. Pat. No. 762,875 issued to Blodgett on Jun. 21, 1904.

Another patent was issued to Sammon on May 28, 1912 as U.S. Pat. No. 1,027,907. Yet another U.S. Pat. No. 1,401,206 was issued to Swartz on Dec. 27, 1921 and still yet another was issued on Oct. 24, 1933 to Mueller as U.S. Pat. No. 1,931,931.

Another patent was issued to Ward on Oct. 9, 1973 as U.S. Pat. No. 3,764,032. Yet another U.S. Pat. No. 3,945,674 was issued to Ide on Mar. 23, 1976. Another was issued to Stohler et al. on Jun. 14, 1983 as U.S. Pat. No. 4,388,032 and still yet another was issued on Nov. 17, 1992 to Boos et al. as U.S. Pat. No. 5,163,726.

Another patent was issued to Allen et al. on Jan. 28, 1981 as U.K. Patent No. GB1583642. Yet another U.K. Patent No. GB2041885 was issued to Krestensen on Sep. 17, 1980. Another was issued to Kenji on Sep. 9, 2004 as Japanese Patent No. JP2004250188 and still yet another was published on Dec. 9, 2004 to McGinley as International Patent No. WO 2004/106214.

U.S. Pat. No. 762,875

Inventor: Omer W. Blodgett

Issued: Jun. 21, 1904

In a sling, the combination with a crossbar having eyes at its ends, of chains secured to the bar, passed up through the eyes and connected together, chains supported U.S. Pat. No. 1,027,907

Inventor: Thomas J. Sammon

Issued: May 28, 1912

In a hoisting sling, the combination of an tipper bar and a lower bar, the said lower bar carrying sleeves on its opposite ends and having an aperture at each end, said sleeves having apertures in their tipper sides to register with the apertures in the lower bar, pulley wheels mounted in said apertures in the lower bar, a rope or cable secured to each end of the upper bar and passing down around the pulley wheel carried in the adjacent end of the lower bar, said upper bar having apertures in its opposite ends through which said ropes or cables move after passing around the pulley wheels, and means for connecting said ropes or cables to a hoisting cable, the said bars constituting a pair of movable jaws to grip the load carried by the sling, between them and prevent displacement thereof.

U.S. Pat. No. 1,401,206

Inventor: Edward G. Swartz

Issued: Dec. 27, 1921

A lumber cradle comprising, in combination, a frame adapted to rest upon the top of the load; an arm hingedly connected to the frame, a suspension device and lifting means both connected to the free end of the arm.

U.S. Pat. No. 1,931,931

Inventor: Paul Frederick Mueller

Issued: Oct. 24, 1933

In a hoisting sling of the type set forth, a frame, two pairs of levers pivotally mounted on the frame and each having two arms, one pair at each end thereof, a clamping bar connecting companion arms of each pair of levers, a hoisting chain connected to the other arm of each lever, a stirrup member depending from each corner of said frame and carrying at its lower end a stirrup and having means at its upper end for adjustably connecting it to said frame to enable the stirrup members to be adjusted vertically to accommodate packages of different thickness or height.

U.S. Pat. No. 3,764,032

Inventor: Oct. 9, 1973

Issued: Oct. 9, 1973

An attachment device especially for lift trucks adapted to engage, lift and transport large freight containers. A support frame is provided for attachment to the lift carriage on the mast of a lift truck so that the horizontal portion' of the frame extends forwardly of the truck. An elongated transverse lifting frame is suspended from corner portions of the horizontal portion of the support frame. A pair of oppositely disposed hydraulic cylinder actuators are connected at their one ends to the horizontal frame portion and extend diagonally in opposite directions for operative connection at their other ends to the lifting frame so that the lifting frame may beside shifted in either direction relative to the truck by energizing one or the other of the cylinders.

U.S. Pat. No. 3,945,674

Inventor: Allan R. Ide

Issued: Mar. 23, 1976

A load-retaining apparatus including a pallet floor having an upstanding cage mounted thereon for receipt within of a load carried on such pallet floor. A horizontally projecting retainer is provided for resting on such load to hold it captive and is carried from such cage by means of pivotable lifting arms coupled with a hoisting device in such a manner that hoisting of the cage causes such arms to rotate and automatically lower the retainer onto such load. When the pallet subsequently comes to rest on the ground and tension is taken off this hoisting device, the arms are biased to their retracted positions to raise the retainer off such load.

U.S. Pat. No. 4,388,032

Inventor: Robert A. Stohler

Issued: Jun. 14, 1983

A lifting and stowage system for lifting and stowing containers within a limited magazine area. The system provides a sway bracing feature during lifting which also functions as a stowage member when completely assembled. The system also includes a pair of guide rails attached vertically to the bulkhead and a carriage that travels up and down the guide rails. A strongback is attached to the carriage and is located over the container that is positioned by a forklift. The system employs a lifting mechanism consisting of a power source, a pulley and cable system, a snatch block which attaches to the carriage, a stowage system which restrains the stack of containers in all directions and deceleration buffers. In operation, the strongback is attached to the container and the snatch block is attached to the carriage. The container is lifted to allow vertical clearance for the next container. The lower container is positioned by a forklift and the upper container is lowered onto it. The tie down system is then installed and the snatch block disconnected and returned to its stow position. The reverse is followed for unstacking.

U.S. Pat. No. 5,163,726

Inventor: Jeffrey J. Boos

Issued: Nov. 17, 1992

A cargo loading system which includes a spreader bar and overheight attachment wherein the overheight attachment incorporates an automatic latching mechanism for the purpose of locking and unlocking engagement of the spreader bar. The automatic latching mechanism is actuated by the twistlocks of the spreader bar and serves to obviate the need for dock-side personnel and the attendant hazardous working conditions posed to these personnel by conventional mounting pin attachment of the spreader bar and overheight attachment.

U.K. Patent Number GB1583642

Inventor: David Allan et al.

Issued: Jan. 28, 1981

A method of supporting and stacking containers comprises raising a first container (50) on an elevator, securing the container in a raised position by means of supports, lowering the elevator, raising a second container (53) on the elevator such that the base of the first container (50) is supported by the top of the second container and releasing the securement of the first container. The elevator may then be raised again and the second container (53) secured by the supports. The elevator can then be lowered clear of the second container. Apparatus for performing the method comprises two supports spaced apart to opposite sides of a container receiving location. Container engagement means are provided on each of the supports which are adjusted for engagement with a container and are capable of supporting the container upon removal of the elevator. Each container engagement means comprises a container engagement member mounted on a support arm which in turn is movably mounted on an associated support.

U.K Patent Number GB2041885

Inventor: Johannas Krestensen

Issued: Sep. 17, 1980

A method of supporting and stacking containers comprises raising a first container (50) on an elevator, securing the container in a raised position by means of supports, lowering the elevator, raising a second container (53) on the elevator such that the base of the first container (50) is supported by the top of the second container and releasing the securement of the first container. The elevator may then be raised again and the second container (53) secured by the supports. The elevator can then be lowered clear of the second container. Apparatus for performing the method comprises two supports spaced apart to opposite sides of a container receiving location. Container engagement means are provided on each of the supports which are adjusted for engagement with a container and are capable of supporting the container upon removal of the elevator. Each container engagement means comprises a container engagement member mounted on a support arm which in turn is movably mounted on an associated support.

U.S. Patent Number JP2004250188

Inventor: Suehiro Kenji

Issued: Sep. 9, 2004

PROBLEM TO BE SOLVED: To prevent occurrence of damage to plate bodies when the plate bodies with brittleness represented by ALC panels are stacked and transferred. SOLUTION: The hoisting fixture A comprises at least two supporting members 1 that are formed substantially equally to or longer than the cargo width of the plate bodies B, are arranged on the lower surface of the plate bodies B, and support them for hoisting a mountain formed by stacking the plurality of plate bodies B having brittleness. The hoisting fixture A comprises a frame 5 having a locked member 7 to be locked to a hook of a crane and a plurality of engaging sections 8 disposed at predetermined positions that are separated equally to or longer than the cargo width of the plate bodies and along the length direction of the plate bodies, and a plurality of nylon slings 4 for connecting the supporting members 1 to the engaging sections 8 in the frame 5.

International Patent Number WO 2004/106214

Inventor: Owen McGinley

Issued: Dec. 9, 2004

A lifting and turning apparatus (1) adapted for connection to an overhead support (B), the apparatus comprising a payload engaging means (12,14) which is operably coupled to and supported by a chain (10) which is driven by a pair of electrically actuable brake/drive units (5,6). A method of manipulating a payload is also described, the method comprising en-aging the payload (R) to a lifting and turning apparatus (1) of the type operably suspended from an overhead support (B) and supporting said payload via a chain driven by brake/drive units and a hoist (2) also including a chain drive for effecting a turning function. Together or separately, by actuating the brake/drive units and/or the hoist, the apparatus may lift, turn, lower or otherwise manipulate the payload. The apparatus includes a simplified, intuitive controller and control technique for the manipulation of the payload.

While these hoist devices may be suitable for the purposes for which they were designed, they would not be as suitable for the purposes of the present invention, as hereinafter described.

SUMMARY OF THE PRESENT INVENTION

The present invention discloses an improved hoisting sling specially for palletized loads comprising a pair of skids having opposing ends, each with a channel terminating in a puck-shaped cavity forming means of engagement of lengths of load bearing members having mating puck-shaped members thereon. The load bearing members extend from distal ends of a spreader frame extending between and having means for engaging the load bearing members. Depending from the intersection of the spreader arms an anchor line extends to a common load bearing member serving as terminus for load bearing members extending to the terminal ends of the spreader arms and also serving as point of attachment for a user selected hoisting device.

A primary object of the present invention is to provide means and apparatus to move a load of palletized material safely.

Another object of the present invention is to provide a hoist sling having a pair of blades each with a terminal end cavity with a channel extending to the tip of the blade.

Yet another object of the present invention is to provide a hoist sling having load bearing members releasably fastenable to the blades.

Still yet another object of the present invention is to provide a hoist sling having load bearing members with a puck-like lifting lug fastened thereto.

Another object of the present invention is to provide a hoist sling having a load bearing member support frame with means for retaining one end of a load bearing member.

Yet another object of the present invention is to provide a hoist sling having load bearing members converging on a hoist sling attachment serving as terminus to the load bearing members.

Additional objects of the present invention will appear as the description proceeds.

The present invention overcomes the shortcomings of the prior art by providing an improved hoisting sling, especially useful on palletized loads comprising a pair of blades having opposing ends, each with a channel terminating in a puck-shaped cavity forming means of engagement for lengths of load bearing members having mating puck-shaped members thereon. The load bearing members extend from distal ends of a spreader frame extending between and having means for engaging the load bearing members. Depending from the intersection of the spreader arms an anchor line extends to a common load bearing member serving as terminus for load bearing members extending to the terminal ends of the spreader arms and also serving as point of attachment for a user selected hoisting device.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
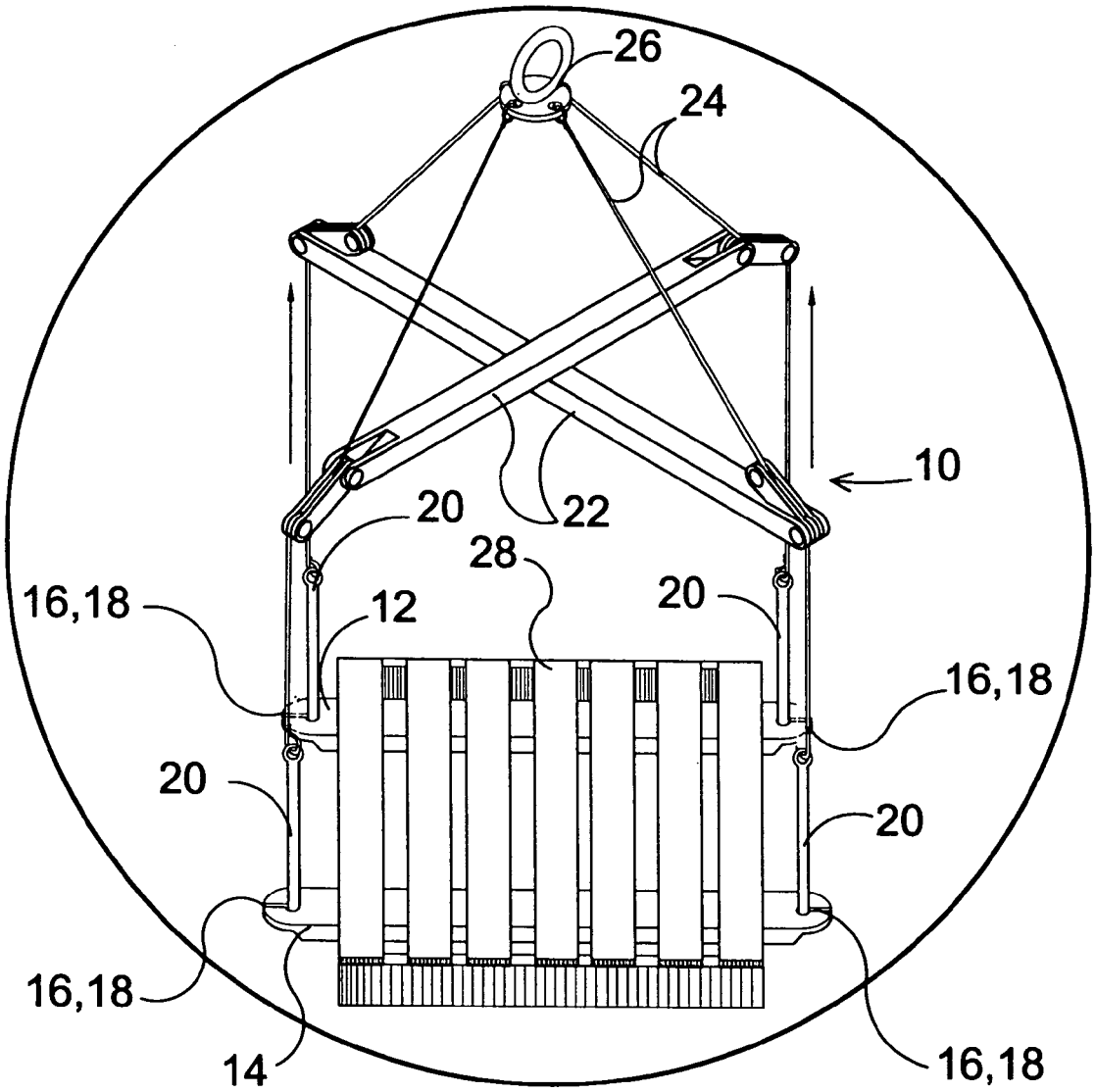
FIG. 1 is an illustrative view of the present invention in use

With regard to reference numerals used, the following numbering is used throughout the drawings.

10 present invention
12 first pallet lift skid
14 second pallet lift skid
16 channel
18 cavity
20 load bearing member
22 spreader frame
24 anchor line
26 lifting ring
28 pallet
30 lifting lug
32 aperture
34 ring
36 disk
38 apertures
40 eyelet
42 anchor line engaging member
44 pivot
46 link

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. Shown is the hoisting sling of the present invention 10 comprising a pair of first and second blades or pallet lift skids 12, 14 having opposing ends, each with a channel 16 terminating in a puck-shaped cavity 18 forming means of engagement for lengths of load bearing members 20 having mating puck-shaped members thereon. The load bearing members 20 extend from distal ends of a spreader frame 22 extending between and having means for engaging 24 the load bearing members 20. Depending from the intersection of the spreader arms an anchor line 24 extends to a common lifting ring or load bearing member 26 serving as terminus for load bearing members 20 extending to the terminal ends of the spreader arms 22 and also serving as point of attachment of a user selected hoisting device (not shown). Also shown is pallet 28.

Figure 2:
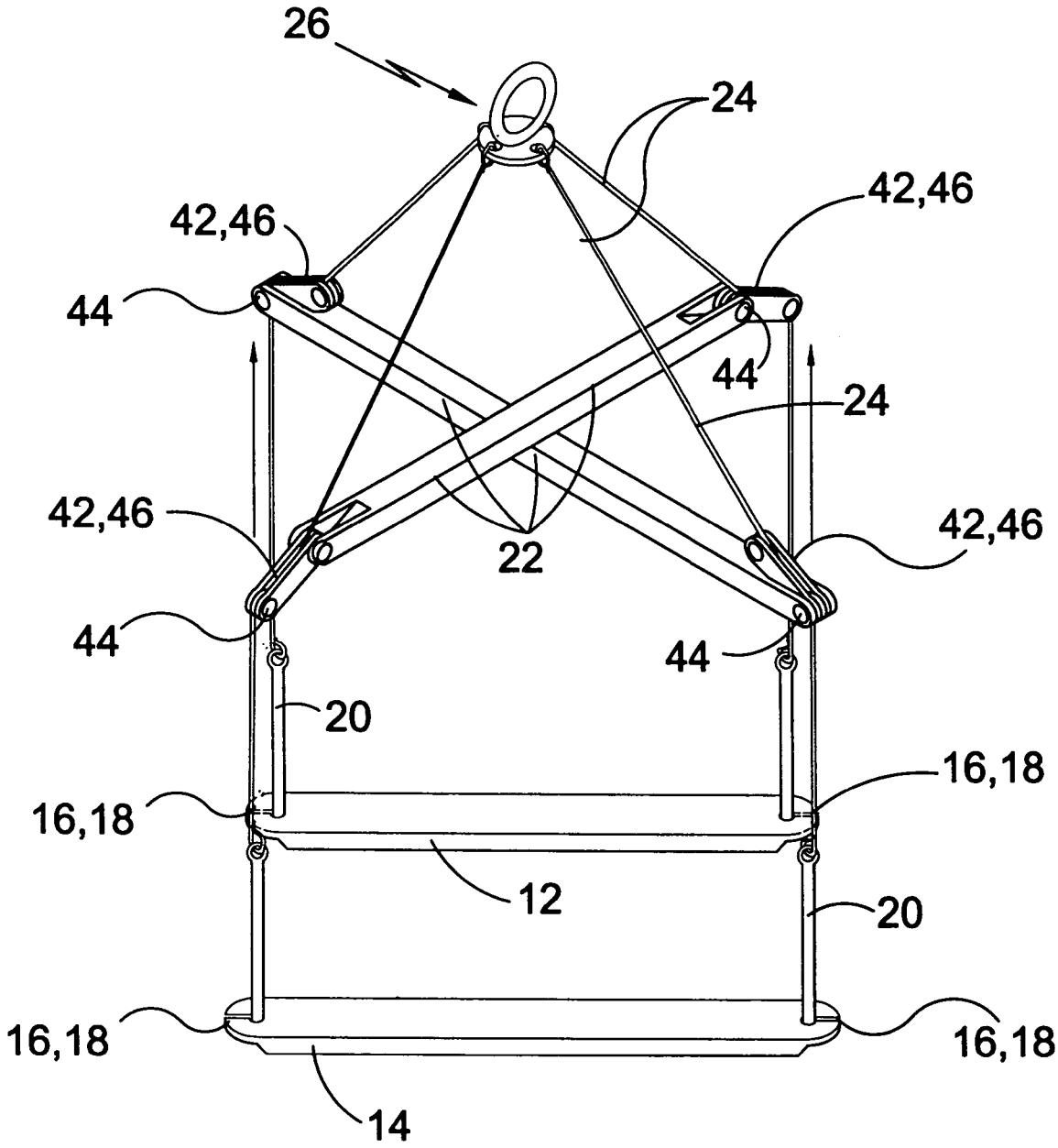
FIG. 2 is a perspective view of the present invention fully assembled.

Turning to FIG. 2, shown therein is a perspective view of the present invention 10 fully assembled. Shown is the hoisting sling of the present invention 10 comprising a pair of blades 12, 14 having opposing ends, each with a channel 16 terminating in a puck-shaped cavity 18 forming means of engagement for lengths of load bearing members 20 having mating puck-shaped members thereon. The load bearing members 20 extend from distal ends of a spreader frame 22 extending between and having means for engaging 24 the load bearing members. Depending from the intersection of the spreader arms an anchor line 24 extends to a common load bearing member 26 serving as terminus for load bearing members 20 extending to the terminal ends of the spreader arms 22 and also serving as point of attachment of a user selected hoisting device. Also shown are a plurality of anchor line engaging members 42 being disposed on each end of each spreader frame 22, wherein one anchor line 24 passes over one anchor line engaging member. Each anchor line engaging member 42 has a 46 having first and second ends, wherein one end of each link is rotatably connected at pivot 44 to an end of each spreader frame 22 so that each link can pivot in the vertical plane so as to vary the length of each spreader frame, wherein one anchor line passes over one link.

Figure 3:
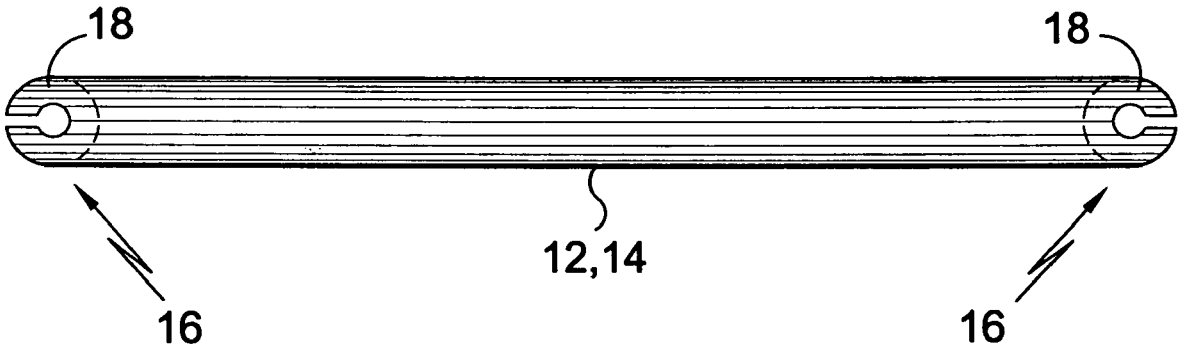
FIG. 3 is a top view of the present inventions pallet lift skid.

Turning to FIG. 3, shown therein is a top view of the present inventions pallet lift skid 12, 14. The present invention is comprised of a pair of skids 12, 14 having opposing ends, each with a channel 16 terminating in a puck-shaped cavity 18 forming means of engagement for lengths of load bearing members having mating puck-shaped members thereon. The load bearing members extend from distal ends of a spreader frame extending between and having means for engaging the load bearing members. Depending from the intersection of the spreader arms an anchor line extends to a common load bearing member serving as terminus for load bearing members extending to the terminal ends of the spreader arms and also serving as point of attachment of a user selected hoisting device.

Figure 4:
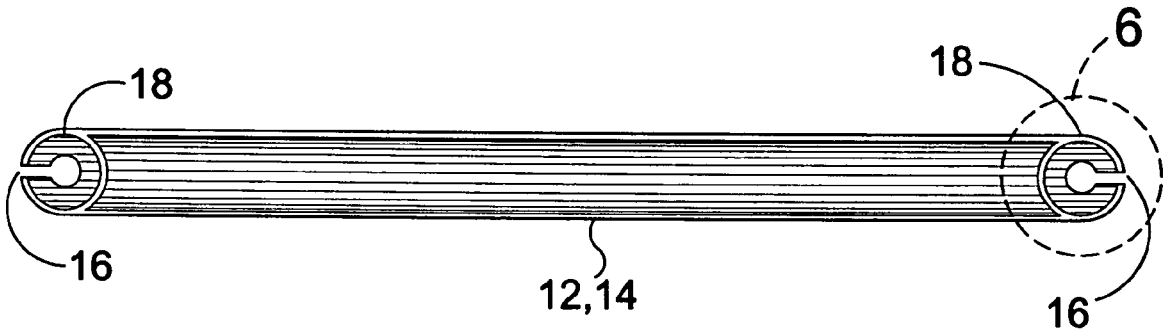
FIG. 4 is a bottom view of the present invention's pallet lift skid.

Turning to FIG. 4, shown therein is a bottom view of the present invention's pallet lift skid 12, 14. The present invention is comprised of a pair of skids 12, 14 having opposing ends, each with a channel 16 terminating in a puck-shaped cavity 18 forming means of engagement for lengths of load bearing members having mating puck-shaped members thereon. The load bearing members extend from distal ends of a spreader frame extending between and having means for engaging the load bearing members. Depending from the intersection of the spreader arms an anchor line extends to a common load bearing member serving as terminus for load bearing members extending to the terminal ends of the spreader arms and also serving as point of attachment of a user selected hoisting device.

Figure 5:
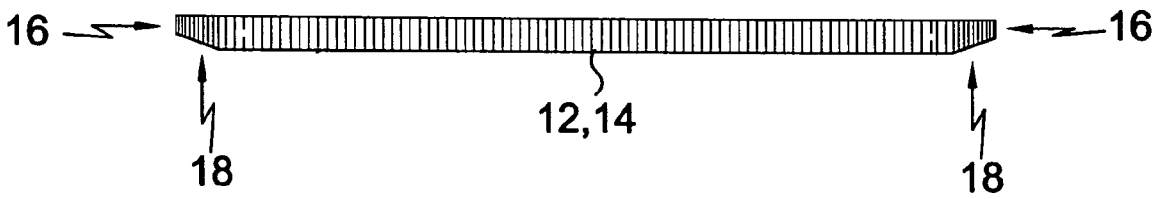
FIG. 5 is a side view of the present invention's pallet lift skid.

Turning to FIG. 5, shown therein is a side view of the present invention's pallet lift skid 12, 14. The present invention is comprised of a pair of skids 12, 14 having opposing ends, each with a channel 16 terminating in a puck-shaped cavity 18 forming means of engagement for lengths of load bearing members having mating puck-shaped members thereon. The load bearing members extend from distal ends of a spreader frame extending between and having means for engaging the load bearing members. Depending from the intersection of the spreader arms an anchor line extends to a common load bearing member serving as terminus for load bearing members extending to the terminal ends of the spreader arms and also serving as point of attachment of a user selected hoisting device.

Figure 6:
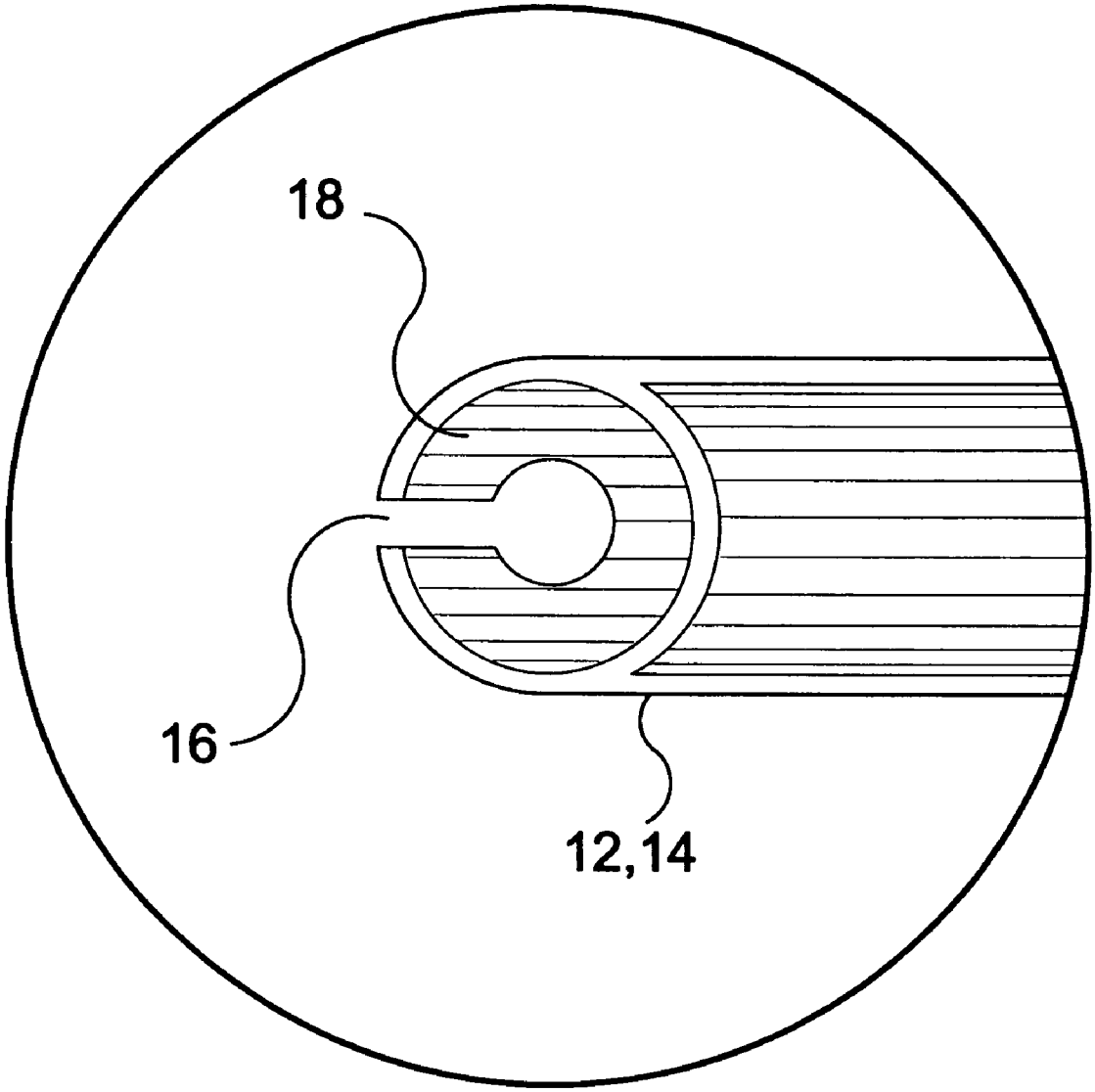
FIG. 6 is a detail view of the present inventions pallet lift skid end portion.

Turning to FIG. 6, shown therein is a detail view of the present inventions pallet lift skid 12, 14 end portion. The present invention is comprised of a pair of skids 12, 14 having opposing ends, each with a channel 16 terminating in a puck-shaped cavity 18 forming means of engagement for lengths of load bearing members having mating puck-shaped members thereon. The load bearing members extend from distal ends of a spreader frame extending between and having means for engaging the load bearing members. Depending from the intersection of the spreader arms an anchor line extends to a common load bearing member serving as terminus for load bearing members extending to the terminal ends of the spreader arms and also serving as point of attachment of a user selected hoisting device.

Figure 7:
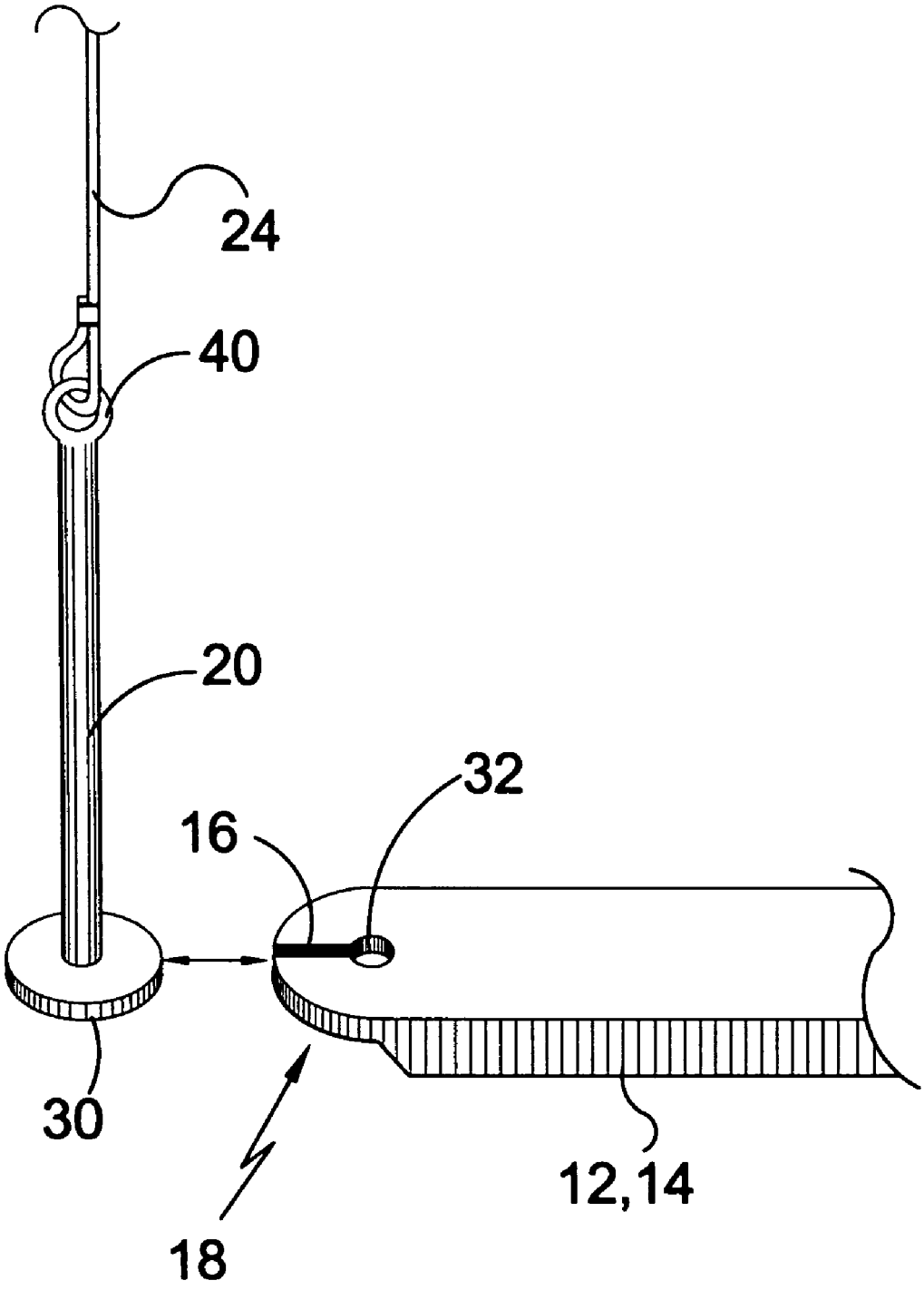
FIG. 7 is a detail view of the present inventions pallet lift skid (end portion) and lifting lug (not connected).

Turning to FIG. 7, shown therein is a detail view of the present inventions pallet lift skid 12, 14 (end portion) and lifting lug 30 (not connected) on the lower end of load bearing member 20. The present invention is comprised of a pair of skids 12, 14 having opposing ends, each with a channel 16 terminating in a puck-shaped cavity 18 forming means of engagement for lugs 30 of load bearing members 20 having mating puck-shaped members 30 thereon. Also shown is aperture 32 for receiving member 20 therein. The load bearing members extend from distal ends of a spreader frame extending between and having means for engaging the load bearing members. Depending from the intersection of the spreader arms an anchor line extends to a common load bearing member serving as terminus for load bearing members 20 extending to the terminal ends of the spreader arms and also serving as point of attachment of a user selected hoisting device. Member 20 has an eyelet 40 on its upper end to which the lower end of line 24 is connected.

Figure 8:
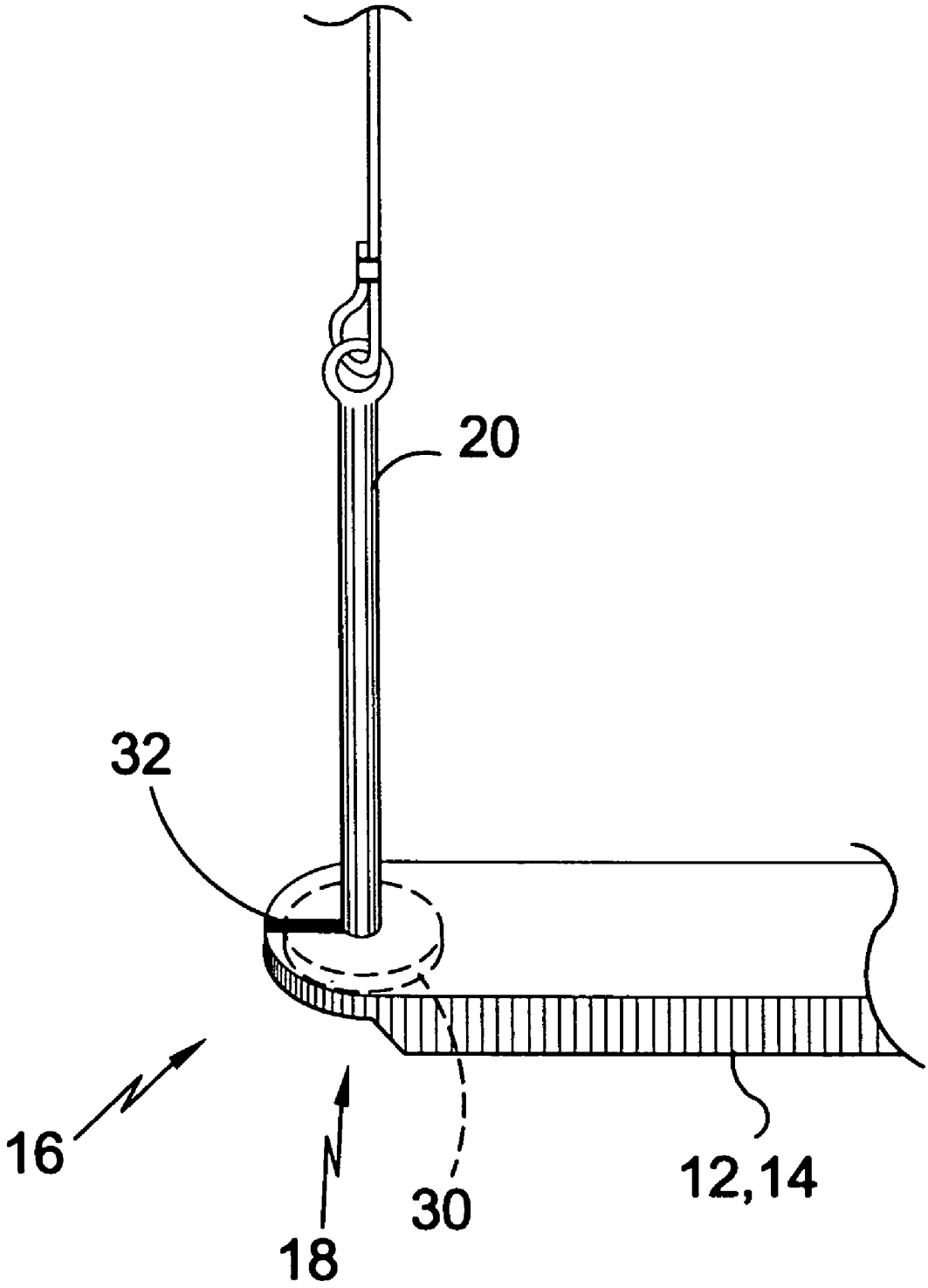
FIG. 8 is a detail view of the present inventions pallet lift skid (end portion) and lifting lug (connected).

Turning to FIG. 8, shown therein is a detail view of the present inventions pallet lift skid 12, 14 (end portion) and lifting lug 30 (connected). The present invention is comprised of a pair of skids 12, 14 having opposing ends, each with a channel 16 terminating in a puck-shaped cavity 18 forming means of engagement for lengths of load bearing members 20 having mating puck-shaped members 30 thereon. Aperture 32 is also shown. The load bearing members extend from distal ends of a spreader frame extending between and having means for engaging the load bearing members. Depending from the intersection of the spreader arms an anchor line extends to a common load bearing member serving as terminus for load bearing members 20 extending to the terminal ends of the spreader arms and also serving as point of attachment of a user selected hoisting device.

Figure 9:
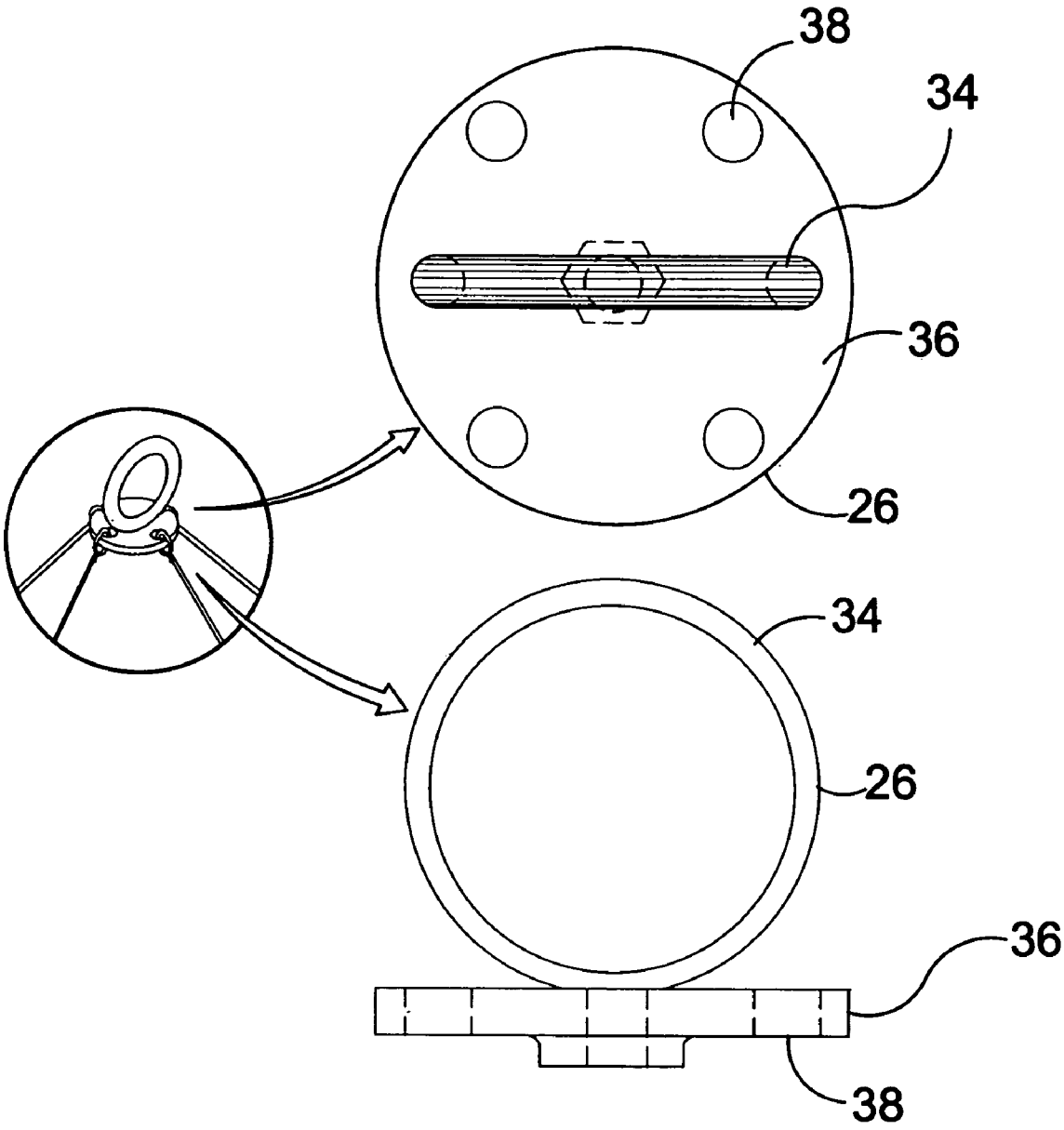
FIG. 9 is a top and side view of the present inventions lifting ring.

Turning to FIG. 9, shown therein is a top and side view of the present inventions lifting ring 26. The present invention is comprised of a pair of blades having opposing ends, each with a channel terminating in a puck-shaped cavity forming means of engagement for lengths of load bearing members having mating puck-shaped members thereon. The load bearing members extend from distal ends of a spreader frame extending between and having means for engaging the load bearing members. Depending from the intersection of the spreader arms an anchor line extends to a common load bearing member 26 serving as terminus for load bearing members extending to the terminal ends of the spreader arms and also serving as point of attachment of a user selected hoisting device. The lifting ring 26 has an upper ring portion 34 and a lower disk portion 36 having a plurality of apertures 38 therein.

Figure 10:
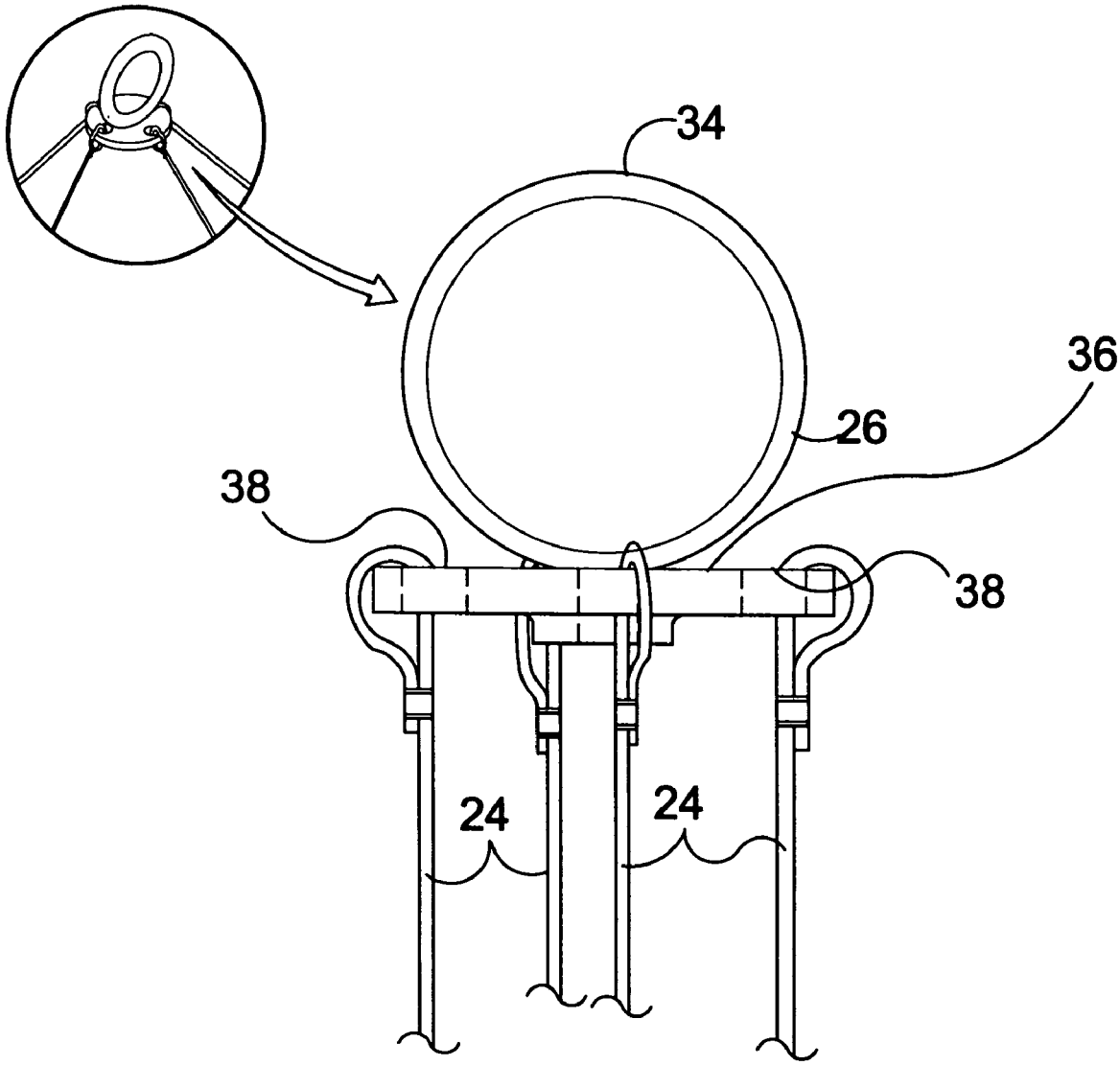
FIG. 10 is a side view of the present inventions lifting ring.

Turning to FIG. 10, shown therein is a side view of the present inventions lifting ring 26. The present invention is comprised of a pair of blades having opposing ends, each with a channel terminating in a puck-shaped cavity forming means of engagement for lengths of load bearing members having mating puck-shaped members thereon. The load bearing members extend from distal ends of a spreader frame extending between and having means for engaging the load bearing members. Depending from the intersection of the spreader arms an anchor line 24 extends to a common load bearing member 26 serving as terminus for load bearing members extending to the terminal ends of the spreader arms and also serving as point of attachment of a user selected hoisting device. Also shown are ring 34, disk 36 and apertures 38.

Figure 11:
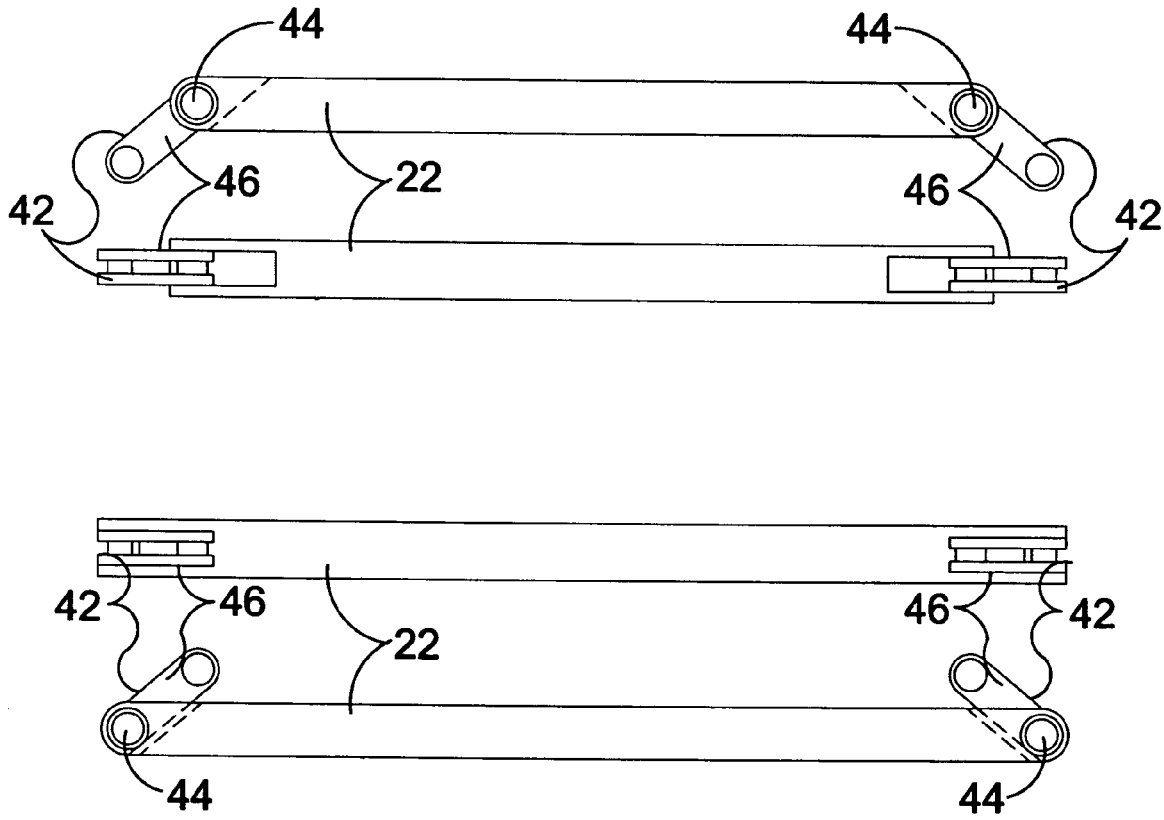
FIG. 11 is a top and side view of the present inventions diagonal spreader bars.

Turning to FIG. 11, shown therein is a top and side view of the present inventions diagonal spreader bars 22. The present invention is comprised of a pair of blades having opposing ends, each with a channel terminating in a puck-shaped cavity forming means of engagement for lengths of load bearing members having mating puck-shaped members thereon. The load bearing members extend from distal ends of a spreader frame 22 extending between and having means for engaging the load bearing members. Depending from the intersection of the spreader arms 22 an anchor line extends to a common load bearing member serving as terminus for load bearing members extending to the terminal ends of the spreader arms and also serving as point of attachment of a user selected hoisting device. Also shown are a plurality of anchor line engaging members 42 being disposed on each end of each spreader frame 22, wherein one anchor line (not shown but see FIG. 2) passes over one anchor line engaging member. Each anchor line engaging member 42 has a link 46 having first and second ends, wherein one end of each link is rotatably connected at pivot 44 to an end of each spreader frame 22 so that each link can pivot in the vertical plane so as to vary the length of each spreader frame, wherein one anchor line passes over one link.

I claim:

1. An apparatus for providing a hoist sling useful for lifting a pallet of material using a hoist; comprising:

a) first and second skids for being disposed underneath the pallet of material so as to support the pallet thereon as the pallet is lifted, each said skid having first and second ends and upper and lower surfaces, each of said first and second ends having a channel therein;

b) first and second spreader frames each having first and second ends and upper and lower surfaces, said spreader frames being criss-crossed so as to be disposed above said skids and the pallet of material;

c) a common load bearing member being disposed above said first and second spreader frames, said common load bearing member having a first, upper end and a second, lower end, wherein said first, upper end is connected to the hoist so that the pallet of material can be lifted by the hoist;

d) a plurality of skid load bearing members each having first, upper and second, lower ends being substantially vertically disposed about the pallet of material so that one skid load bearing member is disposed on each corner of the pallet, wherein each said skid load bearing member is rod shaped, a lug being disposed on said lower end of each said skid load bearing member, wherein one said lug is disposed on said lower surface of each of said first and second ends of said first and second skids so that said skid load bearing member passes through said channel on each of said first and second ends of said first and second skids to permit the skid load bearing members to support the weight of the pallet of material that is supported by the first and second skids; and e) a plurality of anchor lines each having first and second ends, one said anchor line connected to and extending from each said first, upper end of each said skid load bearing member to said common load bearing member to permit the hoist connected to the common load bearing member to lift the first and second skids, wherein one said first end of each said anchor line is connected to one said first, upper end of each said skid load bearing member and one said second end of each said anchor line is connected to said second, lower end of said common load bearing member, wherein one said anchor line passes over one end of each said first and second spreader frames so that each said anchor line is kept separated from each other said anchor line as the pallet of material is lifted by the hoist.

2. The apparatus of claim 1, wherein each said lower surface of each said end of each said skid has a cavity therein, wherein said cavity is complementarily shaped as each said lug so that each said lug will fit into each said cavity so as to secure each said lug to each end of said skids.

3. The apparatus of claim 2, wherein each said channel terminates in an enlarged first aperture, wherein said first aperture is complementarily sized to receive said skid load bearing members therein.

4. The apparatus of claim 3, wherein each said first, upper end of each said skid load bearing member has an eyelet therein, wherein said first end of each said anchor line is connected to said eyelet.

5. The apparatus of claim 4, further comprising an anchor line engaging member being disposed on each said end of each said spreader frame, wherein one said anchor line passes over one said anchor line engaging member.

6. The apparatus of claim 5, each said anchor line engaging member further comprising a link having first and second ends, wherein each said first end of each said link is rotatably connected to each said end of each said spreader frame so that each said link can pivot in the vertical plane so as to vary the length of each said spreader frame, wherein one said anchor line passes over one said link.

7. The apparatus of claim 6, wherein said spreader frames are complementarily sized as the pallet so that said ends of said spreader frames are disposed substantially directly over each corner of the pallet.

8. The apparatus of claim 6, wherein said lugs are disk shaped.

9. The apparatus of claim 8, wherein said first, upper end of said common load bearing member comprises a ring for connection to the hoist.

10. The apparatus of claim 9, wherein said second, lower end of said common load bearing member comprises a disk being disposed in substantially the horizontal plane, a plurality of second apertures being disposed spaced apart about the periphery of said disk so as to correspond to each corner of the pallet, wherein one of said anchor lines is connected to one of said second apertures.

* * * * *